US011204573B2

(12) United States Patent
Araki

(10) Patent No.: US 11,204,573 B2
(45) Date of Patent: Dec. 21, 2021

(54) IMAGE FORMING APPARATUS, FIXING TEMPERATURE DETERMINATION METHOD, AND NON-TRANSITORY COMPUTER READABLE MEDIUM

(71) Applicant: TOSHIBA TEC KABUSHIKI KAISHA, Tokyo (JP)

(72) Inventor: Satoshi Araki, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/091,346

(22) Filed: Nov. 6, 2020

(65) Prior Publication Data

US 2021/0080889 A1 Mar. 18, 2021

Related U.S. Application Data

(63) Continuation of application No. 16/574,760, filed on Sep. 18, 2019, now Pat. No. 10,852,682.

(51) Int. Cl.

| | |
|---|---|
| ***G03G 15/08*** | (2006.01) |
| ***G03G 15/00*** | (2006.01) |
| ***G03G 21/18*** | (2006.01) |
| ***G03G 15/20*** | (2006.01) |

(52) U.S. Cl.

CPC ..... *G03G 15/5045* (2013.01); *G03G 15/0863* (2013.01); *G03G 15/2039* (2013.01); *G03G 15/5041* (2013.01); *G03G 21/1878* (2013.01)

(58) Field of Classification Search

CPC ..... G03G 15/0863; G03G 15/2039; G03G 15/5041; G03G 15/5045; G03G 21/1878; G03G 21/20

See application file for complete search history.

(56) References Cited

U.S. PATENT DOCUMENTS

| | | | |
|---|---|---|---|
| 5,581,335 | A | 12/1996 | Borton et al. |
| 5,852,756 | A | 12/1998 | Teranishi et al. |
| 5,926,666 | A | 7/1999 | Miura et al. |
| 7,177,559 | B2 | 2/2007 | Inoue et al. |
| 7,567,764 | B2 | 7/2009 | Yamanaka et al. |

(Continued)

OTHER PUBLICATIONS

Non-Final Office Action on U.S. Appl. No. 16/574,760 dated May 12, 2020.

(Continued)

*Primary Examiner* — David J Bolduc
(74) *Attorney, Agent, or Firm* — Foley & Lardner LLP

(57) ABSTRACT

An image forming apparatus includes a temperature sensor, a memory, a fixing device, and a controller. The temperature sensor is configured to detect a temperature of an inside of the image forming apparatus. The memory is configured to store temperature history information regarding a history of the temperature of the inside of the image forming apparatus detected by the temperature sensor. The fixing device is configured to fix a toner image onto the paper sheet by heating the paper sheet to a fixing temperature. The toner image is transferred to the paper sheet using a toner stored in a toner cartridge of the image forming apparatus. The controller is configured to control a fixing temperature at the fixing device based on the temperature history information stored in the memory.

20 Claims, 11 Drawing Sheets

(56) References Cited

U.S. PATENT DOCUMENTS

| | | | | |
|---|---|---|---|---|
| 8,331,807 | B2 * | 12/2012 | Homma | G03G 21/1889 399/12 |
| 8,554,091 | B2 | 10/2013 | Homma et al. | |
| 8,666,269 | B2 | 3/2014 | Tanaka | |
| 9,335,681 | B2 | 5/2016 | Ueno | |
| 9,454,105 | B1 | 9/2016 | Onishi | |
| 10,514,641 | B1 | 12/2019 | Kitajima | |
| 2002/0041767 | A1 | 4/2002 | Saito et al. | |
| 2004/0141761 | A1 | 7/2004 | Ikegawa | |
| 2005/0158061 | A1 | 7/2005 | Do | |
| 2007/0098422 | A1 | 5/2007 | Asakura et al. | |
| 2007/0110482 | A1 | 5/2007 | Kazaki et al. | |
| 2007/0122173 | A1 | 5/2007 | Mitsuoka et al. | |
| 2008/0008483 | A1 | 1/2008 | Hamaya et al. | |
| 2008/0145067 | A1 | 6/2008 | Maeda et al. | |
| 2008/0181638 | A1 * | 7/2008 | Fujioka | G03G 15/0893 399/58 |
| 2008/0181674 | A1 | 7/2008 | Kaiho | |
| 2008/0187854 | A1 * | 8/2008 | Yoshida | G03G 9/08795 430/109.4 |
| 2009/0110440 | A1 | 4/2009 | Homma et al. | |
| 2009/0136242 | A1 | 5/2009 | Okamoto et al. | |
| 2009/0153921 | A1 * | 6/2009 | Maeyama | G03G 15/0887 358/504 |
| 2011/0217059 | A1 * | 9/2011 | Kato | G03G 15/20 399/43 |
| 2011/0262159 | A1 | 10/2011 | Takeuchi et al. | |
| 2011/0318022 | A1 | 12/2011 | Ajima | |
| 2012/0002987 | A1 | 1/2012 | Odani | |
| 2013/0022366 | A1 | 1/2013 | Ando | |
| 2013/0236196 | A1 | 9/2013 | Shinohara | |
| 2013/0251386 | A1 | 9/2013 | Ozeki | |
| 2014/0193168 | A1 | 7/2014 | Kimoto | |
| 2015/0063838 | A1 | 3/2015 | Yagi et al. | |
| 2015/0234321 | A1 | 8/2015 | Suzuki | |
| 2015/0338800 | A1 | 11/2015 | Ueno | |
| 2016/0131996 | A1 * | 5/2016 | Kuramashi | G03G 15/0887 399/281 |
| 2017/0364026 | A1 | 12/2017 | Imamiya | |
| 2018/0024483 | A1 | 1/2018 | Kato | |
| 2018/0032029 | A1 | 2/2018 | Yamamoto | |
| 2018/0217535 | A1 | 8/2018 | Koido | |
| 2018/0341206 | A1 | 11/2018 | Miyanishi et al. | |
| 2019/0227472 | A1 | 7/2019 | Hara et al. | |
| 2020/0379381 | A1 * | 12/2020 | Nakajima | G03G 15/2039 |

OTHER PUBLICATIONS

Notice of Allowance on U.S. Appl. No. 16/574,760 dated Jul. 29, 2020.

* cited by examiner

FIG. 4

| CARTRIDGE NO. | CONTROL DATA | | | HIGHEST TEMPERATURE (℃) |
|---|---|---|---|---|
| | IDENTIFICATION CODE | PRODUCTION DATE | … | |
| 1 (2C) | Axx-xxxxxx | 2019. 2.3 | … | 36 |
| 2 (2M) | Cxx-xxxxxx | 2018.10.25 | … | 40 |
| 3 (2Y) | Mxx-xxxxxx | 2018.3.7 | … | 45 |
| 4 (2K) | Yxx-xxxxxx | 2017.12.21 | … | 45 |

FIG. 5

| NUMBER OF DAYS ELAPSED FROM PRODUCTION X (YEAR) | TEMPERATURE CORRECTION VALUE (℃) |
|---|---|
| $0.5 \leq X < 1$ | +3 |
| $1 \leq X < 1.5$ | +5 |
| $1.5 \leq X$ | +10 |

FIG. 6

| TEMPERATURE HISTORY Y (℃) | TEMPERATURE CORRECTION VALUE (℃) |
|---|---|
| $33 \leq Y < 37$ | +3 |
| $37 \leq Y < 42$ | +5 |
| $42 \leq Y$ | +10 |

FIG. 11

| CARTRIDGE NO. | CONTROL DATA | | | |
|---|---|---|---|---|
| | IDENTIFICATION CODE | PRODUCTION DATE | … | HIGHEST TEMPERATURE (℃) |
| 1 (2C) | Axx-xxxxxx | 2019. 2.3 | … | 36 |
| 2 (2M) | Cxx-xxxxxx | 2018.10.25 | … | 40 |
| 3 (2Y) | Mxx-xxxxxx | 2018.3.7 | … | 45 |
| 4 (2K) | Yxx-xxxxxx | 2017.12.21 | … | 45 |

IMAGE FORMING APPARATUS, FIXING TEMPERATURE DETERMINATION METHOD, AND NON-TRANSITORY COMPUTER READABLE MEDIUM

CROSS-REFERENCE TO RELATED PATENT APPLICATION

This application is a continuation of U.S. patent application Ser. No. 16/574,760, filed Sep. 18, 2019, the entire contents of which are incorporated herein by reference.

FIELD

Embodiments described herein relate generally to an image forming apparatus, a fixing temperature determination method, and a non-transitory computer readable medium.

BACKGROUND

An image forming apparatus forms an image on a paper sheet. A general image forming apparatus forms a latent image on a photosensitive body by irradiating the photosensitive body with image light. The image forming apparatus obtains a visible image by visualizing the latent image with a developing agent which is a developer. The image forming apparatus moves the visible image onto the paper sheet. Alternatively, the image forming apparatus moves the visible image onto an intermediate transfer belt for a moment, and further moves the visible image moved onto the intermediate transfer belt onto the paper sheet. Thereafter, the image forming apparatus fixes the visible image, which is moved to the paper sheet, onto the paper sheet by heating in a fixing device.

In recent years, in the image forming apparatus, a low temperature fixing toner is used as a developer for fixing at a lower temperature compared to the related art. The low temperature fixing toner realizes a wide non-offset region using a crystalline polyester resin excellent in low temperature offset resistance. By using the low temperature fixing toner, the heating temperature of the fixing device can be lowered, and thus, energy saving performance can be realized. Since the fixing performance of the low temperature fixing toner changes depending on the number of days elapsed from the production date or the temperature environment, the image forming apparatus needs an apparatus configuration in consideration of the change.

DESCRIPTION OF THE DRAWINGS

FIG. 4 is a view illustrating an example of a cartridge information table stored in a memory of the image forming apparatus;

FIG. 5 is a view illustrating an example of a first temperature correction value table stored in the memory;

FIG. 6 is a view illustrating an example of a second temperature correction value table stored in the memory;

FIG. 11 is a view illustrating an example of a cartridge information table stored in a memory according to a modification example of the image forming apparatus;

DETAILED DESCRIPTION

In general, according to one embodiment, an image forming apparatus that forms an image on a paper sheet is provided. The image forming apparatus includes a temperature sensor, a memory, a fixing device, and a controller. The temperature sensor is configured to detect a temperature of the inside of the image forming apparatus. The memory is configured to store temperature history information that is a history of the temperature of the inside of the image forming apparatus detected by the temperature sensor. The fixing device is configured to fix a toner image onto the paper sheet by heating the paper sheet, to which the toner image with the toner using a crystalline polyester resin is transferred, in accordance with an image to be formed. The controller is configured to control a fixing temperature which is a temperature at heating in the fixing device. The controller is configured to determine the fixing temperature based on the temperature history information stored in the memory.

Hereinafter, exemplary embodiments will be described in detail with reference to the drawings.

Figure 1:
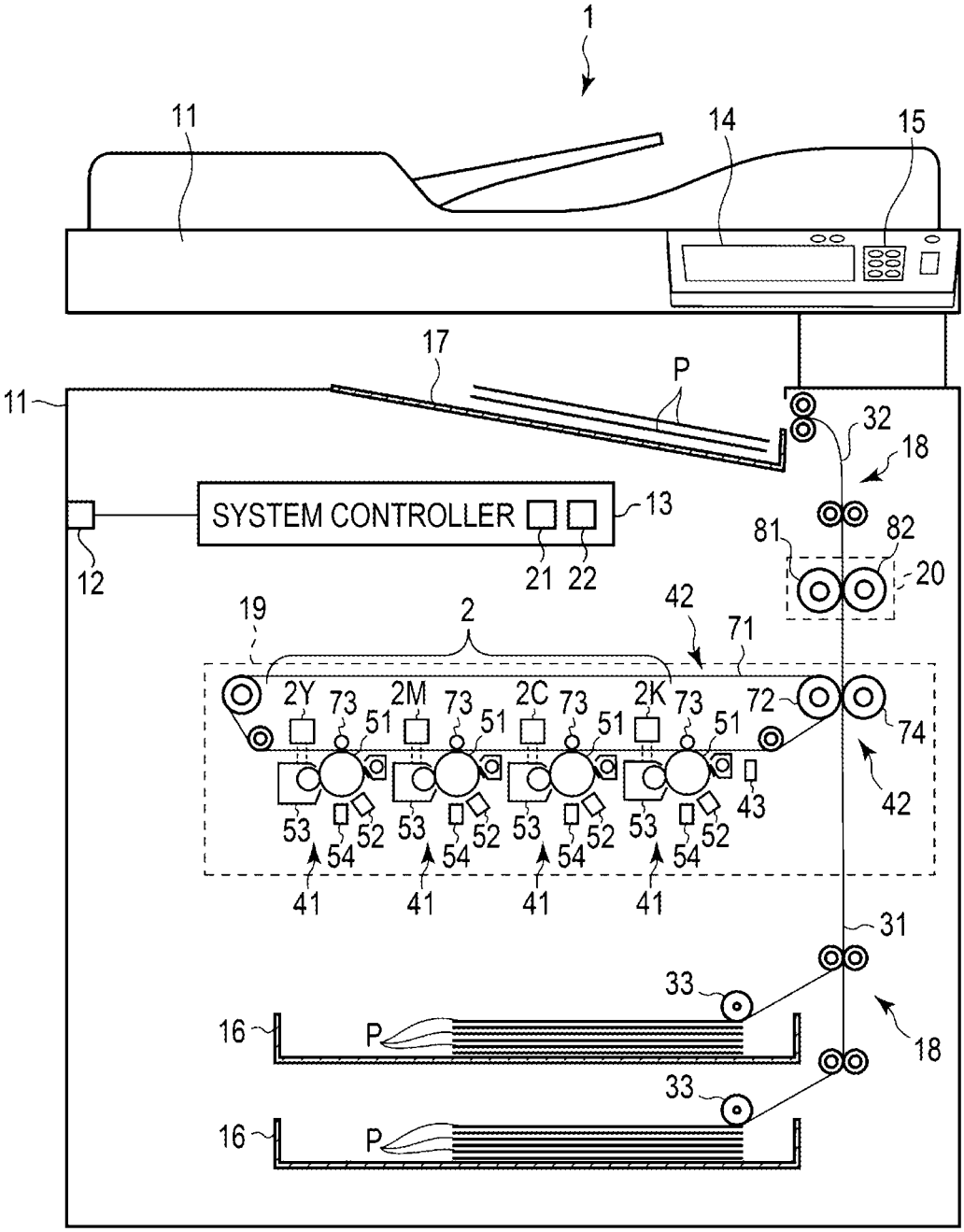
FIG. 1 is a schematic view illustrating a configuration example of the inside of an image forming apparatus according to one embodiment.

FIG. 1 is a schematic view illustrating a configuration example of the inside of the image forming apparatus according to one embodiment.

In the embodiment, as an example of the image forming apparatus, a multifunction peripheral (MFP) will be described. The MFP is a device having a function of forming, that is, printing a desired image on a printing medium which is a sheet-like paper sheet, such as paper or resin sheet, a function of reading the image formed on the printing medium as image information configured with electronic data, and the like. The MFP may also have a function of a facsimile apparatus.

For example, an image forming apparatus 1 has a configuration in which a low temperature fixing toner using a crystalline polyester resin is replenished from a toner cartridge 2 and an image is formed on the printing medium. The low temperature fixing toner is, for example, a toner selected from yellow (Y), magenta (M), cyan (C), black (K) and the like. The image forming apparatus 1 can also select one toner to form a monochrome image with the selected toner on the printing medium.

As illustrated in FIG. 1, the image forming apparatus 1 includes a housing 10, a scanner mechanism 11, a communication interface 12, a system controller 13, a display unit 14, an operation interface 15, a plurality of paper sheet trays 16, a paper discharge tray 17, a conveying unit 18, an image forming unit 19, and a fixing device 20.

The housing 10 is a main body of the image forming apparatus 1. The housing 10 accommodates the scanner mechanism 11, the communication interface 12, the system controller 13, the display unit 14, the operation interface 15, the plurality of paper sheet trays 16, the paper discharge tray 17, the conveying unit 18, the image forming unit 19, and the fixing device 20.

The scanner mechanism 11 acquires a character, an illustration, a photograph, and the like on an object to be read as light and darkness of light, and generates image data that corresponds to the light and darkness. The scanner mechanism 11 includes at least an original document table (original document glass), an illumination device, and an image sensor. The illumination device irradiates an original document supported by the original document table, that is, the object to be read, with illumination light. The image sensor receives the reflected light (image information) reflected by the original document, and generates an image signal by photoelectric conversion of the received reflected light. The image sensor is, for example, a charge coupled device (CCD) sensor or a complementary metal-oxide-semiconductor (CMOS) sensor.

The communication interface 12 is an interface for communicating with other devices. The communication interface 12 is used, for example, for communication with a host device (external device). The communication interface 12 is configured as, for example, a local area network (LAN) connector. In addition, the communication interface 12 may perform wireless communication with other devices in accordance with a standard, such as Bluetooth trademark or Wi-Fi (registered trademark).

The system controller 13 controls the image forming apparatus 1. The system controller 13 includes, for example, a processor 21 and a memory 22. In addition, the system controller 13 is also connected to the conveying unit 18, the image forming unit 19, the fixing device 20 and the like via a bus or the like.

The processor 21 is an arithmetic element that executes arithmetic processing. The processor 21 is, for example, a microprocessor (MPU). The processor 21 performs various types of processing based on data, such as a program stored in the memory 22. The processor 21 functions as a control unit that is capable of executing various operations by executing a program stored in the memory 22.

The processor 21 controls the conveying unit 18, the image forming unit 19, and the fixing device 20 by executing the program stored in the memory 22. The processor 21 executes the program stored in the memory 22 to perform processing of generating a print job to form an image on a printing medium P. For example, the processor 21 generates the print job based on, for example, an image acquired from an external device via the communication interface 12. The processor 21 may generate a print job based on, for example, an image read by the scanner mechanism 11. The processor 21 stores the generated print job in the memory 22.

The print job includes image data indicating an image to be formed on the printing medium P. The image data may be data for forming an image on one printing medium P, or may be data for forming an image on a plurality of printing mediums P. Furthermore, the print job includes information indicating whether color printing or monochrome printing is performed.

The display unit 14 includes a display for displaying a screen in accordance with a video signal input from a display control unit, such as the system controller 13 or a graphic controller (not illustrated). For example, on the display of the display unit 14, screens for various settings of the image forming apparatus 1 are displayed.

The operation interface 15 is connected to an operation member (not illustrated). The operation interface 15 supplies an operation signal that corresponds to the operation of the operation member to the system controller 13. The operation member is, for example, a touch sensor or a keyboard. The touch sensor acquires information indicating a designated position in a certain region. The touch sensor is configured as a touch panel integrally with the display unit 14, and accordingly, a signal indicating the touched position on the screen displayed on the display unit 14 is input into the system controller 13. The keyboard includes a ten key, a power source key, a paper sheet feed key, various function keys, and the like.

Each of the plurality of paper sheet trays 16 is a cassette for accommodating the printing medium P. The paper sheet tray 16 is configured to be able to supply the printing medium P from the outside of the housing 10. For example, the paper sheet tray 16 is configured to be extractable from the housing 10.

The paper discharge tray 17 is a tray that supports the printing medium P discharged from the image forming apparatus 1.

The conveying unit 18 is a mechanism for conveying the printing medium P in the image forming apparatus 1. As illustrated in FIG. 1, the conveying unit 18 includes a plurality of conveying paths. For example, the conveying unit 18 includes a paper feed conveying path 31 and a paper discharge conveying path 32.

The paper feed conveying path 31 and the paper discharge conveying path 32 are configured with a plurality of motors, a plurality of rollers, and a plurality of guides, which are not illustrated. The plurality of motors rotate rollers that interlock with the rotation of a shaft by rotating the shaft under the control of the system controller 13. The plurality of rollers moves the printing medium P by rotating. The plurality of guides control a conveying direction of the printing medium P.

The paper feed conveying path 31 takes in the printing medium P from the paper sheet tray 16 and supplies the taken printing medium P to the image forming unit 19. The paper feed conveying path 31 includes pickup rollers 33 that correspond to each of the paper sheet trays. Each of the pickup rollers 33 respectively takes in the printing medium P of the paper sheet tray 16 into the paper feed conveying path 31.

The paper discharge conveying path 32 is a conveying path for discharging the printing medium P, on which the image is formed, from the housing 10. The printing medium P discharged by the paper discharge conveying path 32 is supported by the paper discharge tray 17.

Next, the image forming unit 19 will be described. The image forming unit 19 is configured to form an image on the printing medium P based on the control of the system controller 13. Specifically, the image forming unit 19 forms an image on the printing medium P based on the print job generated by the processor 21. The image forming unit 19 includes a plurality of process units 41, a transfer mechanism 42, and a temperature and humidity sensor 43.

First, a configuration related to the image formation of the image forming unit 19 will be described. The plurality of process units 41 correspond to each of cyan toner, magenta toner, yellow toner, and black toner, which are the low temperature fixing toners. The toner cartridge 2 having toners of different colors is connected to each of the process units 41. In addition, since the plurality of process units 41 have the same configuration except for a developer to be filled, one process unit 41 will be described.

Figure 2:
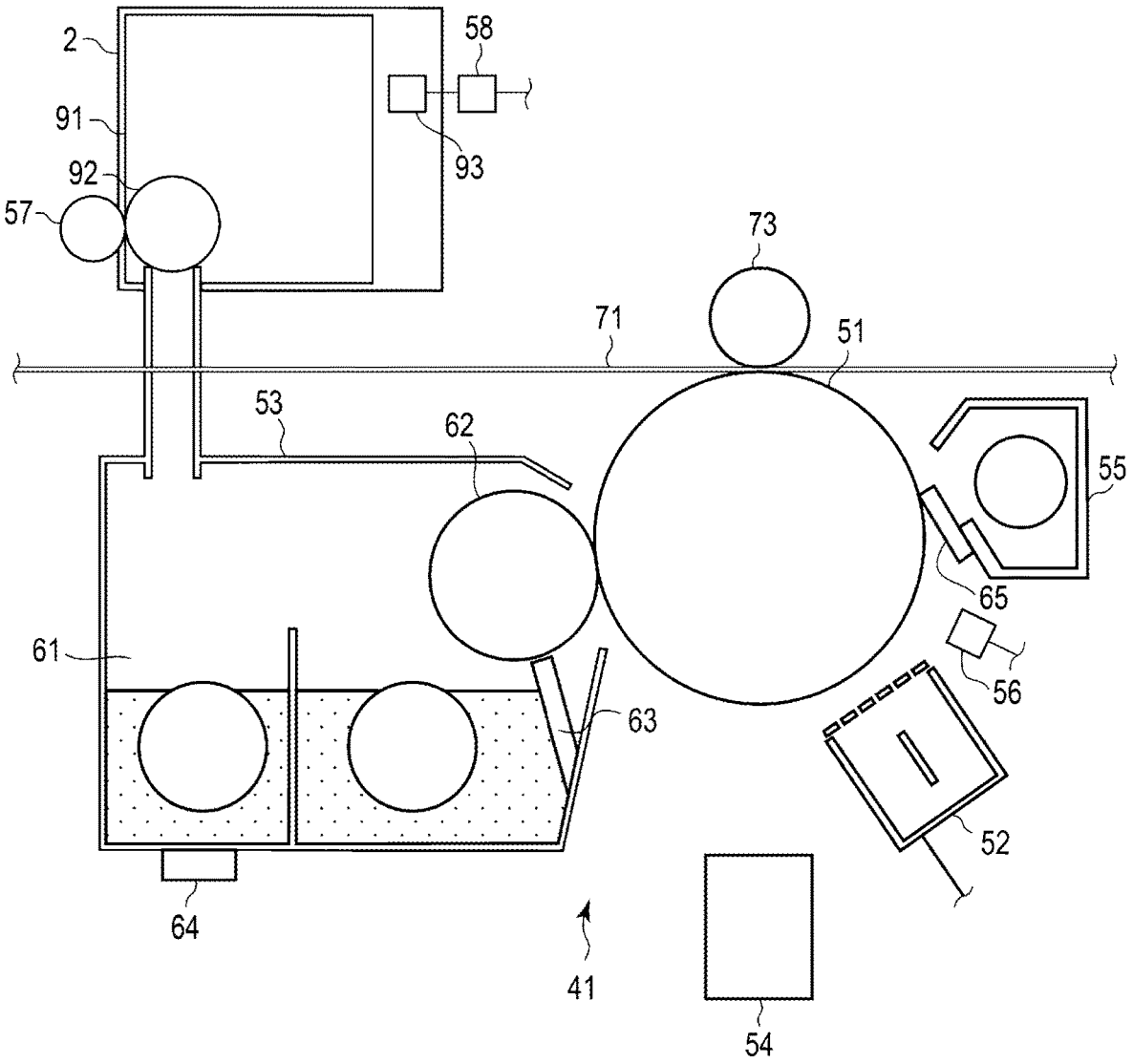
FIG. 2 is a view illustrating a configuration example of a process unit.

FIG. 2 is a view illustrating a configuration example of the process unit 41 of the image forming apparatus according to the embodiment. The process unit 41 includes a photosensitive drum 51, an electrostatic charger 52, and a developing device 53.

In addition, the image forming unit 19 further includes a plurality of exposing devices 54, a plurality of toner cleaners 55, a plurality of drum temperature sensors 56, a plurality of toner replenishing motors 57, and a plurality of communication interfaces 58. The exposing devices 54, the toner cleaners 55, the drum temperature sensors 56, the toner replenishing motors 57, and the communication interfaces 58 are respectively provided for each of the process units 41.

The photosensitive drum 51 is a photosensitive body provided with a cylindrical drum and a photosensitive layer formed on an outer circumferential surface of a drum. The photosensitive drum 51 is rotated at a constant speed by a driving mechanism including a photosensitive drum driving motor (not illustrated).

The electrostatic charger 52 uniformly charges the surface of the photosensitive drum 51. For example, the electrostatic charger 52 applies a voltage (developing bias voltage) to the photosensitive drum 51 using a charging roller to charge the photosensitive drum 51 to a uniform negative electrode potential (contrast potential). The charging roller is rotated by the rotation of the photosensitive drum 51 in a state where a predetermined pressure is applied to the photosensitive drum 51.

The developing device 53 is a device that causes the toner to adhere to the photosensitive drum 51. The developing device 53 includes a developer container 61, a developing roller 62, a doctor blade 63, an automatic toner control (ATC) sensor 64, and the like.

The developer container 61 is a container that contains a developer containing a toner and a carrier. The toner is replenished from the toner cartridge 2. The developing roller 62 is rotated in the developer container 61 by a driving mechanism including a developing roller driving motor (not illustrated). By the rotation, the developing roller 62 carries the developer on the surface thereof. The doctor blade 63 is a member disposed at a predetermined distance from the developing roller 62. The doctor blade 63 adjusts the thickness of the developer carried on the developing roller 62.

The ATC sensor 64 is, for example, a magnetic sensor that includes a coil and detects a voltage value (ATC sensor detection voltage) generated in the coil. The ATC sensor 64 detects the toner density in the developer in the developer container 61 of the developing device 53. In other words, the ATC sensor 64 detects a change in magnetic flux caused by a change in toner density in the developer container 61 as the ATC sensor detection voltage generated in the coil. The ATC sensor 64 supplies the ATC sensor detection voltage to the system controller 13. The amount of toner in the developer container 61 is reflected in the ATC sensor detection voltage. In other words, the system controller 13 can determine the density of the toner that remains in the developer container 61 based on the ATC sensor detection voltage, and can determine whether toner replenishment is necessary. The toner is replenished from the toner cartridge 2 to the developer container 61 based on the ATC sensor detection voltage.

The exposing device 54 includes, for example, a plurality of light emitting elements. The exposing device 54 forms a latent image on the photosensitive drum 51 by irradiating the photosensitive drum 51 with light from the light emitting element, based on the control of the system controller 13. The light emitting element is a light emitting diode (LED) or the like. One light emitting element is configured to emit light to one point on the photosensitive drum 51. The plurality of light emitting elements are arranged in a main scanning direction which is a direction parallel to a rotational shaft of the photosensitive drum 51. The exposing device 54 forms a latent image of one line on the photosensitive drum 51 by irradiating the photosensitive drum 51 with the light by the plurality of light emitting elements arranged in the main scanning direction. Furthermore, the exposing device 54 forms a latent image by continuously irradiating the rotating photosensitive drum 51 with the light.

The toner cleaner 55 removes the toner that remains on the photosensitive drum 51 after transferring the toner image to a primary transfer belt 71 (will be described later) which is an intermediate transfer belt. The toner cleaner 55 includes a blade 65 which is in contact with the surface of the photosensitive drum 51. The toner cleaner 55 removes the toner that remains on the photosensitive drum 51 to be peeled off from the surface of the photosensitive drum 51 by the blade 65.

The drum temperature sensor 56 is disposed in the vicinity of the photosensitive drum 51 and the developer container 61, and detects an ambient temperature in the periphery including the photosensitive drum 51 and the developer container 61. The drum temperature sensor 56 supplies the detected value of the temperature to the system controller 13.

The toner replenishing motor 57 supplies the toner from the toner cartridge 2 to the developing device 53 by rotating the screw of the toner cartridge 2. The toner replenishing motor 57 rotates a driving mechanism (not illustrated). The driving mechanism is connected to the screw (will be described later) of the toner cartridge 2 when the toner cartridge 2 is installed in the image forming apparatus 1. The screw is rotated in conjunction with the rotation of the driving mechanism.

The communication interface 58 is an interface for communicating with the toner cartridge 2.

In the above-described configuration, when the surface of the photosensitive drum 51 charged by the electrostatic charger 52 is irradiated with the light from the exposing device 54, an electrostatic latent image is formed. When a developer layer formed on the surface of the developing roller 62 approaches the photosensitive drum 51, the toner contained in the developer adheres to the latent image formed on the surface of the photosensitive drum. Accordingly, the process unit 41 forms the toner image on the surface of the photosensitive drum 51.

Further, according to the above-described configuration, the processor 21 of the system controller 13 calculates the toner density in the developer container 61 of the developing device 53 based on a reference value (ATC sensor reference value) set in advance and an output of the ATC sensor detection voltage supplied from the ATC sensor 64. Based on the calculated toner density, the processor 21 performs toner replenishment necessity determination processing for determining the necessity of toner replenishment from the toner cartridge 2.

When the processor 21 determines that the amount of toner in the developer container 61 of the developing device 53 decreases in the toner replenishment necessity determination processing, the toner from the toner cartridge 2 is supplied to the developing device 53 by the control of the operation of the toner replenishing motor 57.

The transfer mechanism 42 is configured to transfer the toner image formed on the surface of the photosensitive drum 51 to the printing medium P. The transfer mechanism 42 includes, for example, the primary transfer belt 71 which is an intermediate transfer belt, a secondary transfer opposing roller 72, a plurality of primary transfer rollers 73, and a secondary transfer roller 74.

The primary transfer belt 71 is an endless belt wound around the secondary transfer opposing roller 72 and a plurality of driven rollers. In the primary transfer belt 71, an inner surface (inner circumferential surface) is in contact with the secondary transfer opposing roller 72 and the plurality of driven rollers, and the outer surface (outer circumferential surface) opposes the photosensitive drum 51 of the process unit 41.

The secondary transfer opposing roller 72 is rotated by a motor (not illustrated). The secondary transfer opposing roller 72 conveys the primary transfer belt 71 in a predetermined conveying direction by rotating. The plurality of driven rollers are configured to be freely rotatable. The plurality of driven rollers rotate as the secondary transfer opposing roller 72 moves the primary transfer belt 71.

The plurality of primary transfer rollers 73 are configured to bring the primary transfer belt 71 into contact with the photosensitive drum 51 of the process unit 41. The plurality of primary transfer rollers 73 are provided to correspond to the photosensitive drums 51 of the plurality of process units 41. Specifically, the plurality of primary transfer rollers 73 are respectively provided at positions opposing the photosensitive drums 51 of the corresponding process units 41 with the primary transfer belt 71 interposed therebetween. The primary transfer roller 73 comes into contact with the inner circumferential surface side of the primary transfer belt 71 and displaces the primary transfer belt 71 to the photosensitive drum 51 side. Accordingly, the primary transfer roller 73 brings the outer circumferential surface of the primary transfer belt 71 into contact with the photosensitive drum 51.

The secondary transfer roller 74 is provided at a position opposing the secondary transfer opposing roller 72 with the primary transfer belt 71 interposed therebetween. The secondary transfer roller 74 comes into contact with the outer circumferential surface of the primary transfer belt 71 and applies a pressure thereto. Accordingly, a transfer nip is formed in which the secondary transfer roller 74 and the outer circumferential surface of the primary transfer belt 71 are in close contact with each other. When the printing medium P passes through the transfer nip, the secondary transfer roller 74 presses the printing medium P that passes through the transfer nip against the outer circumferential surface of the primary transfer belt 71.

The secondary transfer roller 74 and the secondary transfer opposing roller 72 convey the printing medium P supplied from the paper feed conveying path 31 in a state where the printing medium P is interposed, by rotating. Accordingly, the printing medium P passes through the transfer nip.

The toner image formed on the surface of the photosensitive drum 51 is transferred to the outer circumferential surface of the primary transfer belt 71. When the image forming unit 19 includes the plurality of process units 41, the primary transfer belt 71 receives the toner image from the photosensitive drums 51 of the plurality of process units 41. The toner image transferred to the outer circumferential surface of the primary transfer belt 71 is conveyed by the primary transfer belt 71 to the transfer nip where the secondary transfer roller 74 and the outer circumferential surface of the primary transfer belt 71 are in close contact with each other. When the printing medium P is present in the transfer nip, the toner image transferred to the outer circumferential surface of the primary transfer belt 71 is transferred to the printing medium P in the transfer nip.

The processor 21 forms toner pattern images of different densities on the primary transfer belt 71 by each of the process units 41 for each toner. The density of the toner pattern image is detected by a density sensor (not illustrated), and the processor 21 can adjust the image forming conditions based on the detection result.

The temperature and humidity sensor 43 measures the entire ambient temperature and the ambient humidity in the image forming unit 19. The temperature and humidity sensor 43 is disposed between the transfer nip and the process unit 41 disposed on the most downstream side in an auxiliary scanning direction which is a direction orthogonal to the main scanning direction of the image forming unit 19. The temperature and humidity sensor 43 supplies the detected values of temperature and humidity to the system controller 13. In addition, the temperature and humidity sensor 43 may be disposed at different positions in the auxiliary scanning direction.

Further, the temperature and humidity sensor 43 may be disposed in the vicinity of each of the plurality of process units 41 and measure the ambient temperature and the ambient humidity in the periphery of each of the process units 41. Instead of the temperature and humidity sensor 43, a temperature sensor may be used.

Next, the configuration related to fixing of the image forming apparatus 1 will be described. The fixing device 20 fixes the toner image onto the printing medium P to which the toner image is transferred. The fixing device 20 operates under the control of the system controller 13. The fixing device 20 includes a heating member that applies the heat to the printing medium P and a pressurizing member that applies pressure to the printing medium P. For example, the heating member is a heat roller 81. In addition, for example, the pressurizing member is a press roller 82.

The heat roller 81 is a fixing rotation body rotated by the driving mechanism including a heat roller motor (not illustrated). The heat roller 81 includes a cored bar made of a hollow metal and an elastic layer formed on the outer circumference of the cored bar. The heat roller 81 is heated to a high temperature by a heater disposed inside the cored bar formed to be hollow. The heater is, for example, a halogen heater. In addition, the heater may also be an induction heating (IH) heater that heats the cored bar by electromagnetic induction.

The press roller 82 is provided at a position opposing the heat roller 81. The press roller 82 includes a cored bar made of metal with a predetermined outer diameter, and an elastic layer formed on the outer circumference of the cored bar. The press roller 82 applies pressure to the heat roller 81 by stress applied from a tension member (not illustrated). When the pressure is applied from the press roller 82 to the heat roller 81, a nip where the press roller 82 and the heat roller 81 are in close contact with each other, which is a so-called fixing nip, is formed. The press roller 82 is rotated by a motor (not illustrated). The press roller 82 moves the printing medium P that entered the fixing nip and presses the printing medium P against the heat roller 81, by rotating.

According to the above-described configuration, the heat roller 81 and the press roller 82 apply heat and pressure to the printing medium P that passes through the fixing nip. Accordingly, the toner image is fixed on the printing medium P that passed through the fixing nip. The printing medium P passed through the fixing nip is introduced into the paper discharge conveying path 32 and discharged to the outside of housing 10.

Next, a configuration of the toner cartridge 2 will be described. The toner cartridge 2 includes a toner cartridge 2C containing a cyan (C) toner, a toner cartridge 2M containing a magenta (M) toner, a toner cartridge 2Y containing a yellow (Y) toner, and a toner cartridge 2K containing a black (K) toner.

As illustrated in FIG. 2, the toner cartridge 2 includes an accommodation container 91, a screw 92, and a cartridge memory 93.

The accommodation container 91 is connected to the developer container 61 of the developing device 53 when the toner cartridge 2 is installed in the image forming apparatus 1.

The screw 92 is a delivery mechanism that is provided in the accommodation container 91 and delivers the toner in the storage container 91 to the developing device 53 by rotating. The screw 92 is driven by the toner replenishing motor 57 of the process unit 41.

The cartridge memory 93 is a recording medium that stores various pieces of control data. The cartridge memory 93 is configured with, for example, an integrated circuit (IC) chip. The cartridge memory 93 may be further configured as a microcomputer provided with a processor. The cartridge memory 93 is connected to the communication interface 58 of the image forming apparatus 1 when the toner cartridge 2 is installed in the image forming apparatus 1. The communication interface 58 may be configured such that the electrical terminals of the cartridge memory 93 are directly connected to the terminals on the image forming apparatus 1 side. Further, the cartridge memory 93 may be a label in which control data is recorded as a visible image, such as a two-dimensional barcode. In this case, the communication interface 58 of the image forming apparatus 1 is configured with an optical reader that optically reads the visible image.

The control data is, for example, "identification code", "production date", "toner properties" or the like. The "identification code" is for identifying the toner cartridge 2 and indicates the model number and the like of the toner cartridge. The "identification code" may be a code representing the color of each toner. The "production date" is the date when the toner cartridge 2 was produced. In other words, the "production date" is information indicating the date when the toner is contained in the toner cartridge 2. The "toner properties" are information indicating the properties of the toner contained in the toner cartridge 2. For example, "toner properties" are temperature information on melting, such as a glass transition point (Tg) of the toner.

The toner accommodated in the toner cartridge 2 is a low temperature fixing toner containing at least a crystalline polyester resin. In addition, in the present embodiment, the crystalline polyester resin refers to a resin in which the ratio of the softening point to the melting temperature (softening point/melting temperature) is 0.8 to 1.2.

The polyester resin component can be produced, for example, using a compound as disclosed in U.S. Pat. No. 9,665,024 with reference to the method of the same disclosure.

Examples of a binder resin for toners other than the crystalline polyester resin include polyester, styrene acryl, polyurethane, epoxy resin and the like. As polyester, for example, as a raw material monomer of polyester, an alcohol component having a valence of 2 or more and a carboxylic acid component (for example, a carboxylic acid having a valence of 2 or more, a carboxylic anhydride, or a carboxylic ester) are used. Examples of styrene acrylics include polymers of styrenes, copolymers of styrenes and dienes, copolymers of styrenes and alkyl (meth) acrylates, and the like.

The crystalline polyester resin is preferably 3 to 20 parts by weight with respect to 100 parts by weight of the binder resin. When the crystalline polyester resin is less than 3 parts by weight, the low temperature fixability cannot be satisfied, and when the crystalline polyester resin is more than 20 parts by weight, the storage stability cannot be satisfied.

As a coloring agent, carbon black, organic or inorganic pigments, dyes and the like are used. As the carbon black, for example, acetylene black, furnace black, thermal black, channel black, ketjen rack, and the like can be used alone or in combination. As pigments or dyes, for example, fast yellow G, benzidine yellow, indo fast orange, irgazine red, carmine FB, permanent Bordeaux FRR, pigment orange R, resole red 2G, lake red C, rhodamine FB, rhodamine B lake, phthalocyanine blue, pigment blue, brilliant green B, phthalocyanine green, and quinacridone can be used alone or in combination.

In addition, examples of the wax include, for example, aliphatic hydrocarbon wax, oxide of aliphatic hydrocarbon wax or block copolymer thereof, animal wax, mineral wax, wax containing fatty acid ester as a main component, or wax obtained by deoxidizing a part or the entirety of fatty acid ester, and the like. Examples of aliphatic hydrocarbon waxes include, for example, low molecular weight polyethylene, low molecular weight polypropylene, polyolefin copolymer, polyolefin wax, microcrystalline wax, paraffin wax, Fischer-Tropsch wax, and the like. The aliphatic hydrocarbon wax includes, for example, an acid value polyethylene wax. Examples of animal waxes include candelilla wax, carnauba wax, vegetable wax, jojoba wax, plant wax such as rice wax, bees wax, lanolin, sperm wax, and the like. Examples of mineral waxes include ozokerite, ceresin, petrolactam, and the like. Examples of waxes containing fatty acid esters as a main component include montanate ester waxes, castor waxes, and the like. Examples of fatty acid esters include deacidified carnauba wax and the like.

Figure 3:
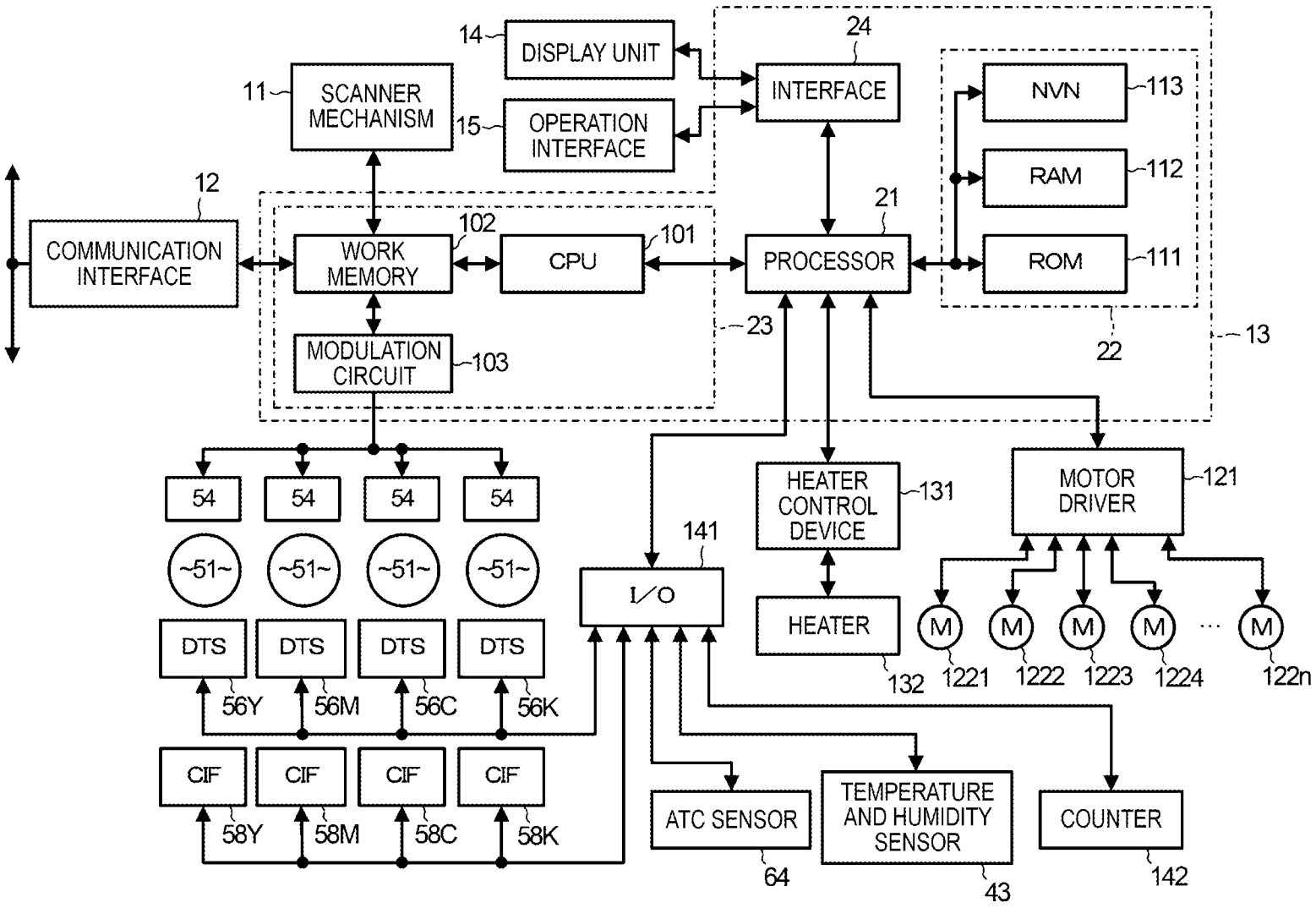
FIG. 3 is a block diagram illustrating an electric configuration example of the image forming apparatus.

FIG. 3 is a block diagram schematically illustrating an electric configuration example of the image forming apparatus according to the embodiment.

The system controller 13 includes an image processing unit 23 and an interface 24 in addition to the processor 21 and the memory 22. The image processing unit 23 includes a central processing unit (CPU) 101, a work memory 102, a modulation circuit 103, and the like.

The CPU 101 controls the image processing unit 23. The work memory 102 is a page memory used for processing in the CPU 101. The work memory 102 stores an image signal generated by the scanner mechanism 11 or image data from the communication interface 12.

In order to convert the image signal or the image data stored in the work memory 102 into image data suitable for image formation by the image forming unit 19, the CPU 101 performs predetermined image processing with respect to the image signal or the image data. The predetermined processing includes, for example, character specification, contour correction, color tone correction (color conversion, RGB→CMY, density), halftone (gradation), γ characteristics (output density with respect to input density value), and the like for an output image (print-out). The image signal and the image data to which the image processing is performed can be stored in a storage device (not illustrated), such as a hard disk drive (HDD). Further, the image signal and the image data can also be stored in a semiconductor memory (not illustrated), and the like that can be picked up from the image forming apparatus 1.

The modulation circuit 103 is an exposure signal generation unit that converts the image data to which the image processing is performed into a modulated signal, that is, an exposure signal to be used as the exposure light by each of the exposing devices 54.

The interface 24 is an interface for exchanging signals and data with the display unit 14 and the operation interface 15.

Examples of the memory 22 include a read-only memory (ROM) 111 which is a program memory, a random-access memory (RAM) 112 used by the processor 21 as a work memory, and a non-volatile memory (NVM) 113 which stores various control parameters even in a state where the image forming apparatus 1 is not powered on.

The process 21 is connected to a motor driver 121 that controls the rotation of any of motors 1221, 1223, 1224, . . . , and 122*n* provided in the image forming unit 19. The motors 1221 to 122*n* include, for example, a plurality of motors for driving the process unit 41, the primary transfer belt 71 and the like. Further, the motors 1221 to 122*n* include a plurality of motors that drive elements from the paper sheet tray 16 to the paper discharge tray 17 related to the conveyance of the paper sheet, such as the pickup roller 33, the secondary transfer counter roller 72, the secondary transfer roller 74, the heat roller 81, press roller 82 and the like. For example, the motor 1221 can be a heat roller motor that drives the heat roller 81, the motor 1222 can be a toner replenishing motor 57, and the motor 1223 can be a developing roller motor.

The processor 21 is also connected to a heater control device 131 for driving a heater 132 that sets a temperature of the fixing device 20.

The processor 21 is further connected to an I/O port 141, and an output and the like from a plurality of sensors provided in respective units of the image forming unit 19 are input via the I/O port 141. The plurality of sensors include, for example, a temperature and humidity sensor 43, four drum temperature sensors 56, and an ATC sensor 64. The drum temperature sensor 56 is abbreviated as DTS in FIG. 3. The four drum temperature sensors 56 include a DTS 56C for the process unit 41 using the toner cartridge 2C, a DTS 56M for the process unit 41 using the toner cartridge 2M, a DTS 56Y for the process unit 41 using the toner cartridge 2Y, and a DTS 56K for the process unit 41 using the toner cartridge 2K.

The four communication interfaces 58 provided in the image forming unit 19 are also connected to the I/O port 141. The communication interface 58 is abbreviated as CIF in FIG. 3. The four communication interfaces 58 include a CIF 58C that communicates with the cartridge memory 93 of the toner cartridge 2C, a CIF 58M that communicates with the cartridge memory 93 of the toner cartridge 2M, a CIF 58Y that communicates with the cartridge memory 93 of the toner cartridge 2Y, and a CIF 58K that communicates with the cartridge memory 93 of the toner cartridge 2K. The processor 21 can acquire control data from the cartridge memory 93 of the toner cartridge 2 through each communication interface 58 via the I/O port 141. Further, when the cartridge memory 93 is configured with an IC chip, the processor 21 can also write data in the cartridge memory 93 of the toner cartridge 2 by each communication interface 58 via the I/O port 141.

Furthermore, a counter 142 that counts the number of printing mediums on which the image is formed by the print job is connected to the I/O port 141.

FIG. 4 is a view illustrating an example of a cartridge information table stored in the memory 22 of the image forming apparatus 1 according to the embodiment. The cartridge information table stores cartridge information with each of the installed toner cartridges 2 as one record, as illustrated in the drawing. The cartridge information includes control data read from the cartridge memory 93 of each toner cartridge 2 and temperature history information indicating the highest temperature covered by the toner cartridge 2. The control data is read from the cartridge memory 93 when, for example, the toner cartridge 2 is replaced and installed in the image forming apparatus 1. The temperature history information can be updated as necessary, for example, based on the temperature acquired by the temperature and humidity sensor 43 each time an image formation on one printing medium P is performed. The cartridge information table is stored in the NVM 113 in the memory 22 such that the cartridge information table can be held even in a state where the image forming apparatus 1 is not powered on.

FIG. 5 is a view illustrating an example of a first temperature correction value table stored in the memory 22 of the image forming apparatus according to the embodiment. The first temperature correction value table is a table in which the relationship between the number of days elapsed from the production date of the toner cartridge 2 and the temperature correction value is set. With reference to the first temperature correction value table, at the temperature correction value that corresponds to the number of days elapsed from the production date of the toner cartridge 2, the system controller 13 corrects the fixing temperature which is the heating temperature of the printing medium P by the heater 132 of the fixing device 20. For example, the system controller 13 sets the fixing temperature to +3° C. when a toner of which the number of days elapsed from the production date is half a year to less than one year is used, sets the fixing temperature to +5° C. when a toner of which the number of days elapsed from the production date is one year to less than one year and a half is used, and sets the fixing temperature to +10° C. when a toner of which the number of days elapsed from the production date is one year and a half or longer is used. The first temperature correction value table can be stored, for example, in the NVM 113 when the image forming apparatus 1 is produced. Further, the first temperature correction value table stored in the NVM 113 can be updated by the maintenance operation of a service person at the time of inspection and repair by the service person who maintains the image forming apparatus 1. Furthermore, the first temperature correction value table may be updated from an external device via the communication interface 12. In addition, the temperature correction value illustrated in FIG. 5 is an example, and the temperature correction value of the toner of which the number of days elapsed from the production date is half a year can be set to a range of +3° C. to +5° C., the temperature correction value of the toner of which the number of days elapsed from the production date is one year can be set to a range of +5° C. to +10° C., and the temperature correction value of the toner of which the number of days elapsed from the production date is one year and a half can be set to a range of +10° C. to +15° C. In addition, depending on the characteristics of the toner, there is a case where another temperature correction value is obtained.

FIG. 6 is a view illustrating an example of a second temperature correction value table stored in the memory 22 (NVM 113) of the image forming apparatus 1 according to the embodiment. The second temperature correction value table is a table in which the relationship between the temperature history information and the temperature correction value of the toner cartridge 2 is set. With reference to the second temperature correction value table, at the temperature correction value that corresponds to the highest temperature covered by the toner cartridge 2, the system controller 13 corrects the fixing temperature which is the heating temperature of the printing medium P by the heater 132 of the fixing device 20. For example, the system controller 13 sets the fixing temperature to +3° C. when a toner of which the highest temperature of the history of the toner cartridge 2 is 33° C. to 37° C. or lower is used, sets the fixing temperature to +5° C. when a toner of which the highest temperature of the history of the toner cartridge 2 is 37° C. to 42° C. or less is used, and sets the fixing temperature to +10° C. when a toner of which the highest temperature of the history of the toner cartridge 2 is 42° C. or higher is used. The second temperature correction value table can be stored, for example, in the NVM 113 when the image forming apparatus 1 is produced. Further, the second temperature correction value table stored in the NVM 113 may also be updated by a service person or an external device, similar to the first temperature correction value table. In addition, the temperature correction value illustrated in FIG. 6 is an example, and the temperature correction value of the toner of which the highest temperature is 33° C. or higher can be set to be a range of +3° C. to +5° C., the temperature correction value of the toner of which the highest temperature is 37° C. or higher can be set to be a range of +5° C. to +10° C., and the temperature correction value of the toner of which the highest temperature is 42° C. or higher can be set to be a range of +10° C. to +15° C. In addition, depending on the characteristics of the toner, there is also a case where another temperature correction value is obtained.

Hereinafter, the operation of the image forming apparatus 1 will be described. Further, the contents of processing described hereinafter is one example, and various processing capable of obtaining the same result can be appropriately used.

Although the configuration of the image forming apparatus 1 for forming a multi-color image is described with reference to FIGS. 1 to 3, it is also possible to configure a monochrome image forming apparatus, for example, by providing only one process unit 41 that uses the toner cartridge 2K accommodating the black toner therein. Here, in order to make it easy to understand the embodiment, the operation of the monochrome image forming apparatus will be described first.

Figure 7:
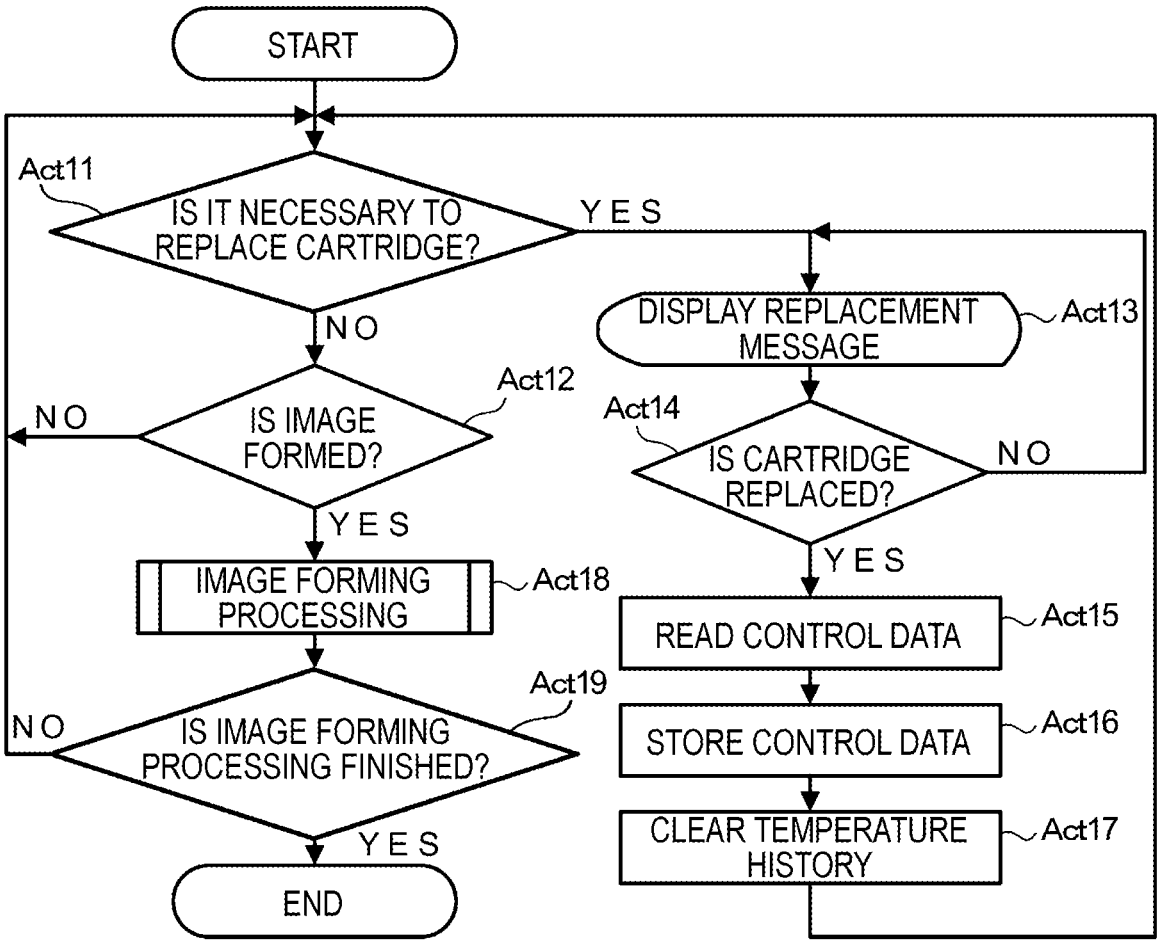
FIG. 7 is a flowchart illustrating an example of operation processing when the image forming apparatus according to the embodiment is a monochrome image forming apparatus.

FIG. 7 is a flowchart illustrating an example of operation processing when the image forming apparatus 1 according to the embodiment is a monochrome image forming apparatus. The processor 21 performs the control processing illustrated in FIG. 7 according to a control program stored in the ROM 111.

The processor 21 determines whether it is necessary to replace the toner cartridge 2 (Act 11). For example, the processor 21 can know that the toner in the toner cartridge 2 runs out according to the change in the output of the ATC sensor 64 when the operation of supplying the toner from the toner cartridge 2 to the developing device 53 is performed based on the output of the ATC sensor 64. The processor 21 determines the necessity or unnecessity of the replacement of the toner cartridge 2 based on whether the toner in the toner cartridge 2 runs out.

When it is determined that replacement of the toner cartridge 2 is not necessary (NO in Act 11), the processor 21 determines whether to form an image (Act 12). For example, when receiving the image data from an external device via the communication interface 12, the processor 21 determines to form an image. In this case, the processor 21 may not determine to form the image until receiving an image formation (print) instruction of the user from the operation interface 15 after receiving the image data. In addition, even when an image formation (copy) instruction of the user is received from the operation interface 15 and the image signal is supplied from the scanner mechanism 11, the processor 21 determines to form an image.

When it is determined not to perform the image formation (NO in Act 12), the processor 21 determines the necessity of cartridge replacement in Act 11 again.

When it is determined that the toner cartridge 2 needs to be replaced (YES in Act 11), the processor 21 displays a replacement message of the toner cartridge 2 on the display unit 14 (Act 13). The processor 21 determines whether the toner cartridge 2 is replaced (Act 14). The processor 21 can determine, for example, whether the toner cartridge 2 is replaced, from the output of a cartridge sensor (not illustrated) provided exclusively. Otherwise, the processor 21 can determine whether the toner cartridge 2 is replaced from the change in the communication state with the cartridge memory 93 by the communication interface 58.

When it is determined that the toner cartridge 2 is not replaced (NO in Act 14), the processor 21 continues the display of the replacement message on the display unit 14 in Act 13.

When it is determined that the toner cartridge 2 is replaced (YES in Act 14), the processor 21 reads the control data recorded in the cartridge memory 93 of the replaced toner cartridge 2 through the communication interface 58 (Act 15). The processor 21 stores the read control data in the cartridge information table (Act 16). The processor 21 clears the temperature history information in the cartridge information table (Act 17). In this manner, the processor 21 rewrites the control data and the temperature history information corresponding to the replacement of the toner cartridge 2. After this, the processor 21 determines the necessity of cartridge replacement in Act 11 again.

When it is determined in Act 12 to perform the image formation (YES in Act 12), the processor 21 forms an image on the printing medium P by an image formation processing subroutine (Act 18).

Figure 8:
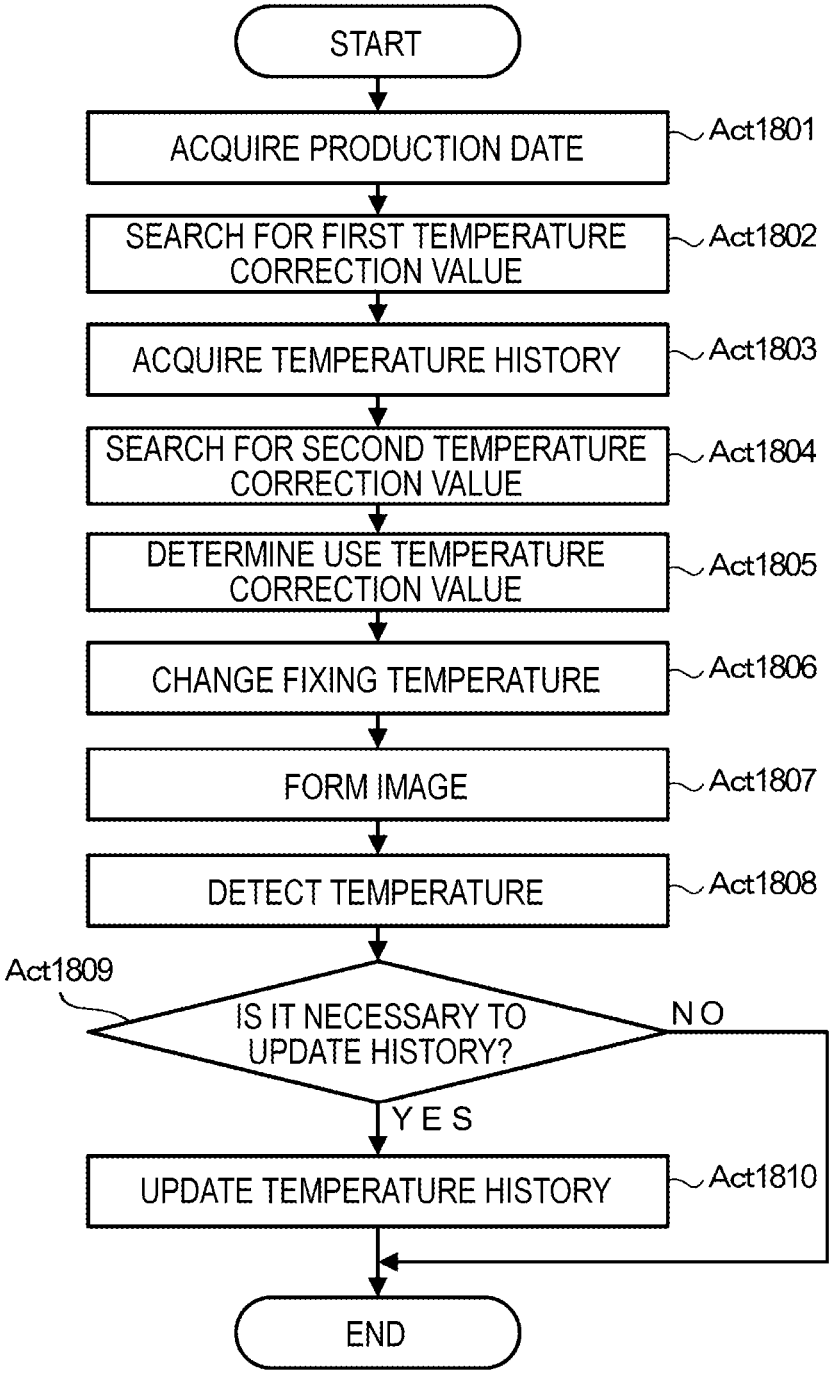
FIG. 8 is a flowchart illustrating an example of an image forming processing subroutine in FIG. 7.

FIG. 8 is a flowchart illustrating an example of the image forming processing subroutine in FIG. 7. The processor 21 acquires the production date from the cartridge information table (Act 1801). The processor 21 obtains the acquired number of days elapsed from the production date to the current day, and searches for the temperature correction value to be the first temperature correction value from the first temperature correction value table (Act 1802). Further, the processor 21 acquires the temperature history information from the cartridge information table (Act 1803). The processor 21 searches for the temperature correction value to be the second temperature correction value from the second temperature correction value table, from the acquired temperature history information (Act 1804). In addition, the processing order of the processing of Act 1801 and Act 1802 and the processing of Act 1803 and Act 1804 may be reversed. In other words, after performing the processing of Act 1803 and Act 1804, the processing of Act 1801 and Act 1802 may be performed. In addition, the processing order of the processing of Act 1801 and Act 1802 and the processing of Act 1803 and Act 1804 may be performed in parallel.

The processor 21 determines which of the first temperature correction value searched in Act 1802 and the second temperature correction value searched in Act 1804 is to be the actually used temperature correction value (Act 1805). The processor 21 determines the higher temperature correction value of the first temperature correction value and the second temperature correction value, as the use temperature correction value. The processor 21 changes the fixing temperature in the fixing device 20, which is set based on the characteristics of toner at the time of production, according to the determined use temperature correction value (Act 1806). When a crystalline polyester resin is used, when the toner is formed, a compatible component of the crystalline polyester resin and the non-crystalline polyester resin obtains the toner having excellent low temperature fixing characteristics. However, under the long-term or high-temperature environment, since the crystallization (annealing) of the crystalline polyester resin from the compatible component of the crystalline polyester resin and the non-crystalline polyester resin proceeds, the fixing performance deteriorates. Therefore, in the embodiment, the fixing temperature setting in consideration of the fixing performance after the progress of the annealing is changed to perform fixing by the fixing device 20.

The processor 21 forms an image on the printing medium P by the fixing temperature setting changed in this manner (Act 1807).

After the image formation is finished, the processor 21 detects the entire ambient temperature in the image forming unit 19 by the temperature and humidity sensor 43 (Act 1808). The processor 21 determines whether it is necessary to update the temperature history information stored in the cartridge information table (Act 1809). The processor 21 compares the highest temperature of the temperature history information with the temperature detected in Act 1808 to determine the necessity of updating the temperature history information. When the temperature detected in Act 1808 is not higher than the highest temperature of the temperature history information, the processor 21 determines that the updating is unnecessary (NO in Act 1809). In this case, the processor 21 ends the image formation processing subroutine.

When the temperature detected in Act 1808 is higher than the highest temperature of the temperature history information, the processor 21 determines that the updating is necessary (YES in Act 1809). In this case, the processor 21 updates the temperature history information in the cartridge information table to the temperature detected in Act 1808 (Act 1810). In addition, the processor 21 ends the image formation processing subroutine.

When an image is formed on the printing medium P by the processing of the image formation processing subroutine in this manner, the processor 21 determines whether the processing is finished (Act 19). When the power source of the image forming apparatus 1 is turned off, the processor 21 determines that the processing is finished (YES in Act 19) and ends the process.

When it is determined that the image formation is not finished yet (NO in Act 19), the processor 21 determines the necessity of cartridge replacement in Act 11 again.

Figure 9:
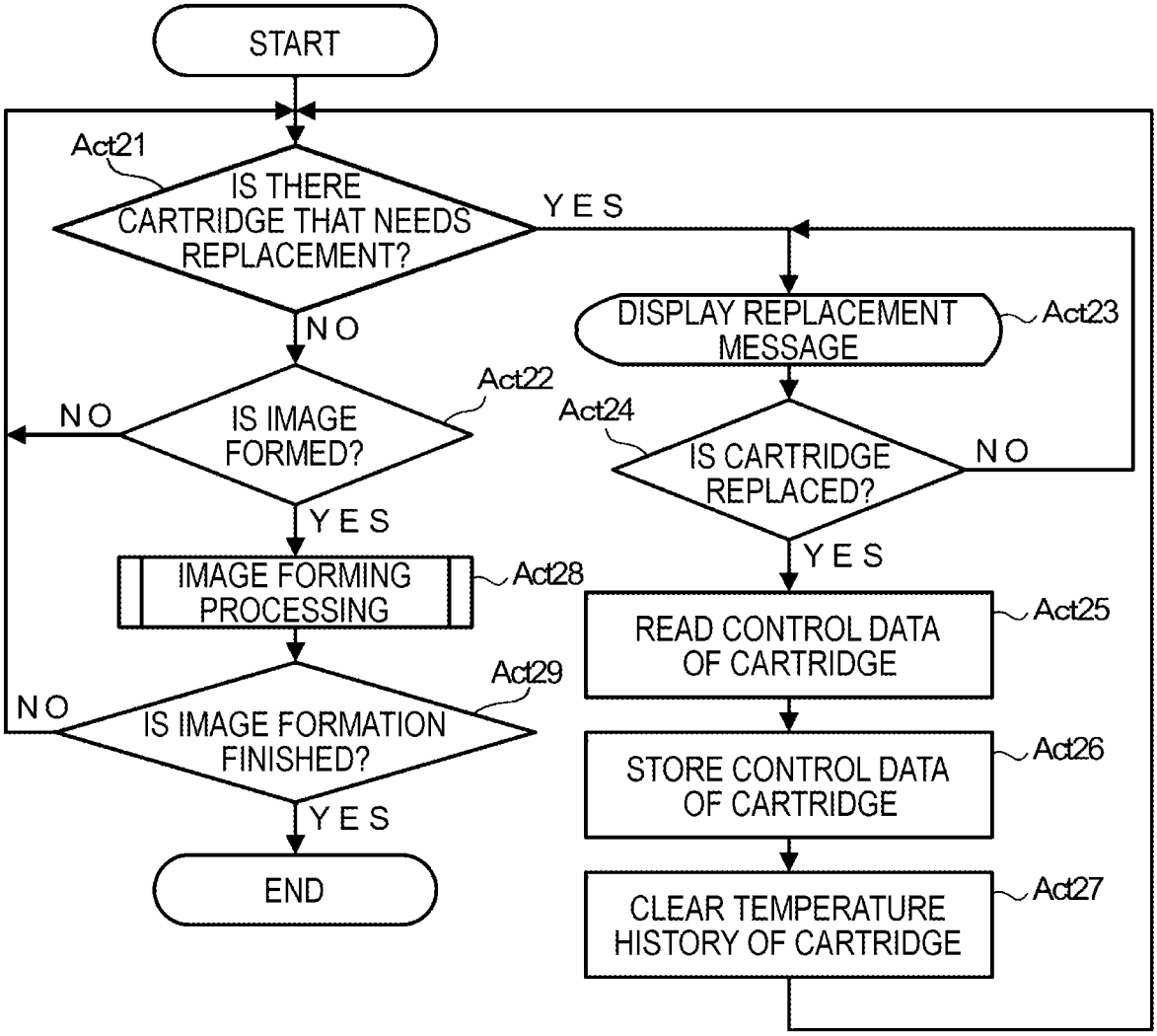
FIG. 9 is a flowchart illustrating an example of the operation processing.

Next, the operation of the image forming apparatus 1 for forming a multicolor image will be described. FIG. 9 is a flowchart illustrating an example of the operation processing of the image forming apparatus 1 according to the embodiment. The processor 21 performs the control processing illustrated in FIG. 9 according to the control program stored in the ROM 111.

The processor 21 determines whether it is necessary to replace any of the toner cartridges 2 (Act 21). In the image forming apparatus for forming a monochrome image, only one toner cartridge is installed, and thus, the processor 21 only needs to determine the necessity of the toner cartridge to be replaced. In the image forming apparatus 1 for forming a multicolor image, the processor 21 determines the necessity of the replacement with respect to each of the four installed toner cartridges 2C, 2M, 2Y, and 2K.

When it is determined that the replacement of any of the toner cartridges 2 is not necessary (NO in Act 21), the processor 21 determines whether to form an image (Act 22). When it is determined not to perform the image formation (NO in Act 22), the processor 21 determines the necessity of cartridge replacement in Act 21 again.

When it is determined that any of the toner cartridges 2 needs to be replaced (YES in Act 21), the processor 21 displays a replacement message of the toner cartridge 2 determined to be necessarily replaced on the display unit 14 (Act 23). The processor 21 determines whether the toner cartridge 2 is replaced (Act 24). When it is determined that the toner cartridge 2 is not replaced (NO in Act 24), the processor 21 continues the display of the replacement message on the display unit 14 in Act 23.

When it is determined that the toner cartridge 2 is replaced (YES in Act 24), the processor 21 reads the control data recorded in the cartridge memory 93 of the replaced toner cartridge 2 through the communication interface 58 (Act 25). The processor 21 stores the read control data in a record of the cartridge of the cartridge information table (Act 26). The processor 21 clears the temperature history information in the record of the cartridge of the cartridge information table (Act 27). In this manner, the processor 21 rewrites the control data and the temperature history information of the toner cartridge 2 corresponding to the replacement of the toner cartridge 2. After this, the processor 21 determines the necessity of cartridge replacement in Act 21 again.

In addition, when it is determined in Act 22 to perform the image formation (YES in Act 22), the processor 21 forms an image on the printing medium P by an image formation processing subroutine (Act 28).

Figure 10:
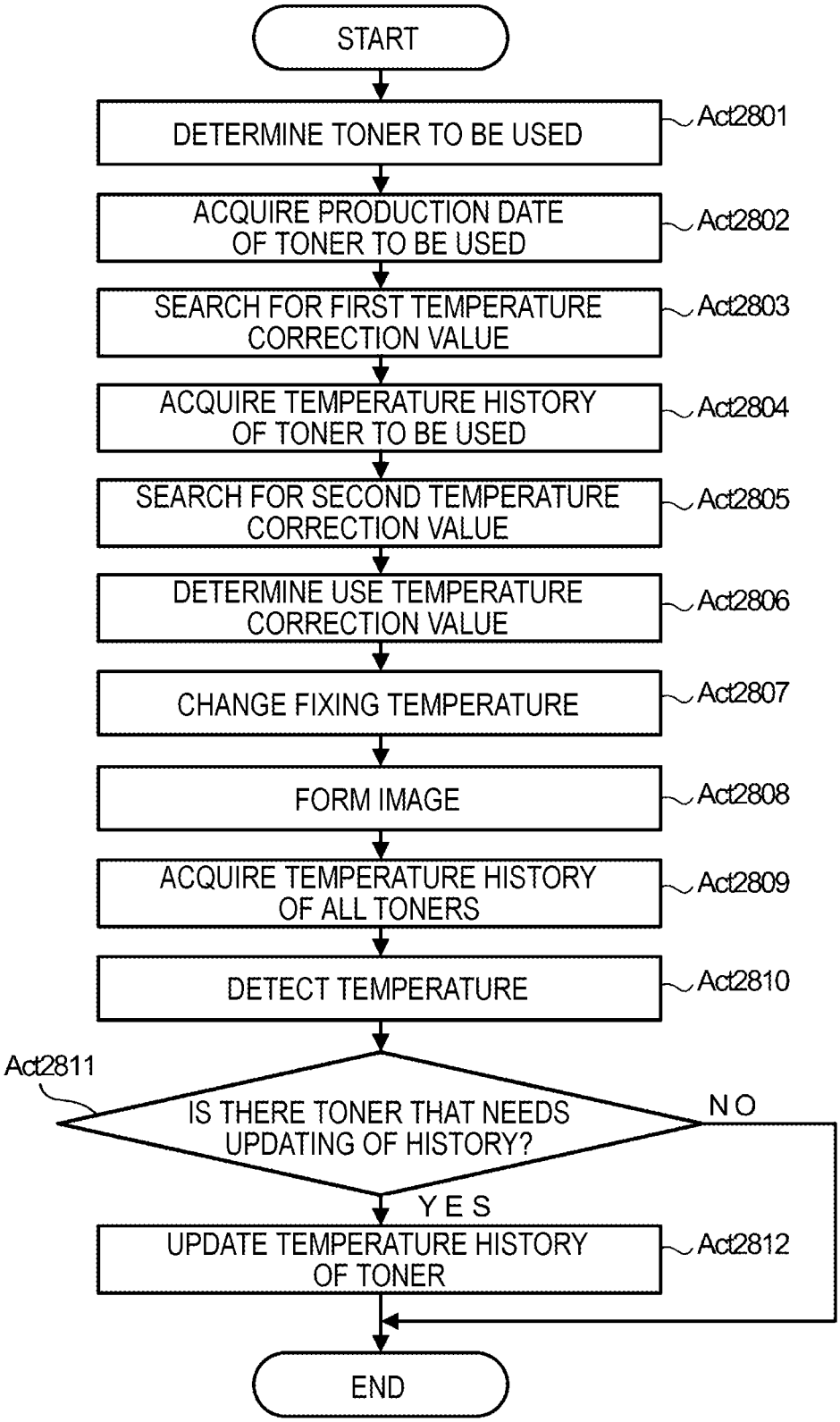
FIG. 10 is a flowchart illustrating an example of an image forming processing subroutine in FIG. 9.

FIG. 10 is a flowchart illustrating an example of the image forming processing subroutine in FIG. 9. The processor 21 determines the toner to be used for the image formation (Act 2801). In Act 22, when the image formation is instructed by the external device via the communication interface 12 or by the user from the operation interface 15, it is also instructed in which manner the image formation is to be performed. In other words, it is instructed whether to perform monochrome image formation or multi-color image formation. The monochrome image formation is monochrome image formation by the black (K) color low temperature fixing toner accommodated in the toner cartridge 2K. In addition, at the time of the multi-color image formation, there is also an apparatus that can instruct which of the multi-color image formation by low temperature fixing toners of three CMY colors accommodated in toner cartridges 2C, 2M, and 2Y and the multi-color image formation by low temperature fixing toners of four CMYK colors accommodated in toner cartridges 2C, 2M, 2Y, and 2K, is to be performed.

The processor 21 acquires the production date of each toner to be used determined in Act 2801 from the cartridge information table (Act 2802). The processor 21 obtains each acquired number of days elapsed from the production date to the current day, and by using the largest number of days elapsed from the production date, searches for the temperature correction value to be the first temperature correction value from the first temperature correction value table (Act 2803). In addition, the processor 21 acquires the temperature history information of each toner to be used determined in Act 2801 from the cartridge information table (Act 2804). The processor 21 searches for the temperature correction value to be the second temperature correction value from the second temperature history information using the highest temperature among the acquired highest temperatures indicated by each temperature history information (Act 2805).

The processor 21 determines which of the first temperature correction value searched in Act 2803 and the second temperature correction value searched in Act 2805 is to be the actually used temperature correction value (Act 2806). The processor 21 changes the fixing temperature in the fixing device 20, which is set based on the characteristics of toner at the time of production, according to the determined use temperature correction value (Act 2807). The processor 21 forms the image on the printing medium P by the fixing temperature setting changed in this manner (Act 2808).

After the image formation is finished, the processor 21 acquires the temperature history information of each of all toners including the toner that is not used in the image formation in Act 2808 from the cartridge information table (Act 2809). The processor 21 detects the entire ambient temperature in the image forming unit 19 by the temperature and humidity sensor 43 (Act 2810). The processor 21 determines whether there is a toner that needs updating of temperature history information (Act 2811). The processor 21 compares the temperature history information of each toner acquired in Act 2809 with the temperature detected in Act 2810 to determine the toner that needs the update of the temperature history information. When there is no toner of which the temperature detected in Act 2810 is higher than the highest temperature of the temperature history information stored in the cartridge information table, the processor 21 determines that there is no toner that needs updating (NO in Act 2811). In this case, the processor 21 ends the image formation processing subroutine.

When there is the toner of which the temperature detected in Act 2810 is higher than the highest temperature of the temperature history information, the processor 21 determines that there is a toner that needs updating (YES in Act 2811). In this case, the processor 21 updates the temperature history information of the toner cartridge 2 of the cartridge information table to the temperature detected in Act 2810 (Act 2812). In addition, the processor 21 ends the image formation processing subroutine.

In this manner, the processing of Act 29 after the image is formed on the printing medium P by the processing of the image forming processing subroutine is the same as the processing of Act 19 described with reference to FIG. 7. Therefore, the description of the processing will be omitted.

Further, when the cartridge memory 93 of the toner cartridge 2 is configured with an IC chip, the processor 21 can also write information in the cartridge memory 93 by the communication interface 58. For example, the temperature history information is stored in the cartridge memory 93, that is, the temperature history information can be also used as one of the control data stored in the cartridge memory 93. Accordingly, for example, the toner cartridge 2 in use in a certain image forming apparatus 1 can also be detached from the image forming apparatus 1 and can be installed in another image forming apparatus for use. Hereinafter, this case will be described as a modification example.

FIG. 11 is a view illustrating an example of the cartridge information table stored in the memory 22 according to a modification example of the image forming apparatus 1 according to the embodiment. In the cartridge information table, the cartridge information is only the control data read from the cartridge memory 93 of each toner cartridge 2, and the control data includes the temperature history information indicating the highest temperature covered by each toner cartridge 2.

Figure 12:
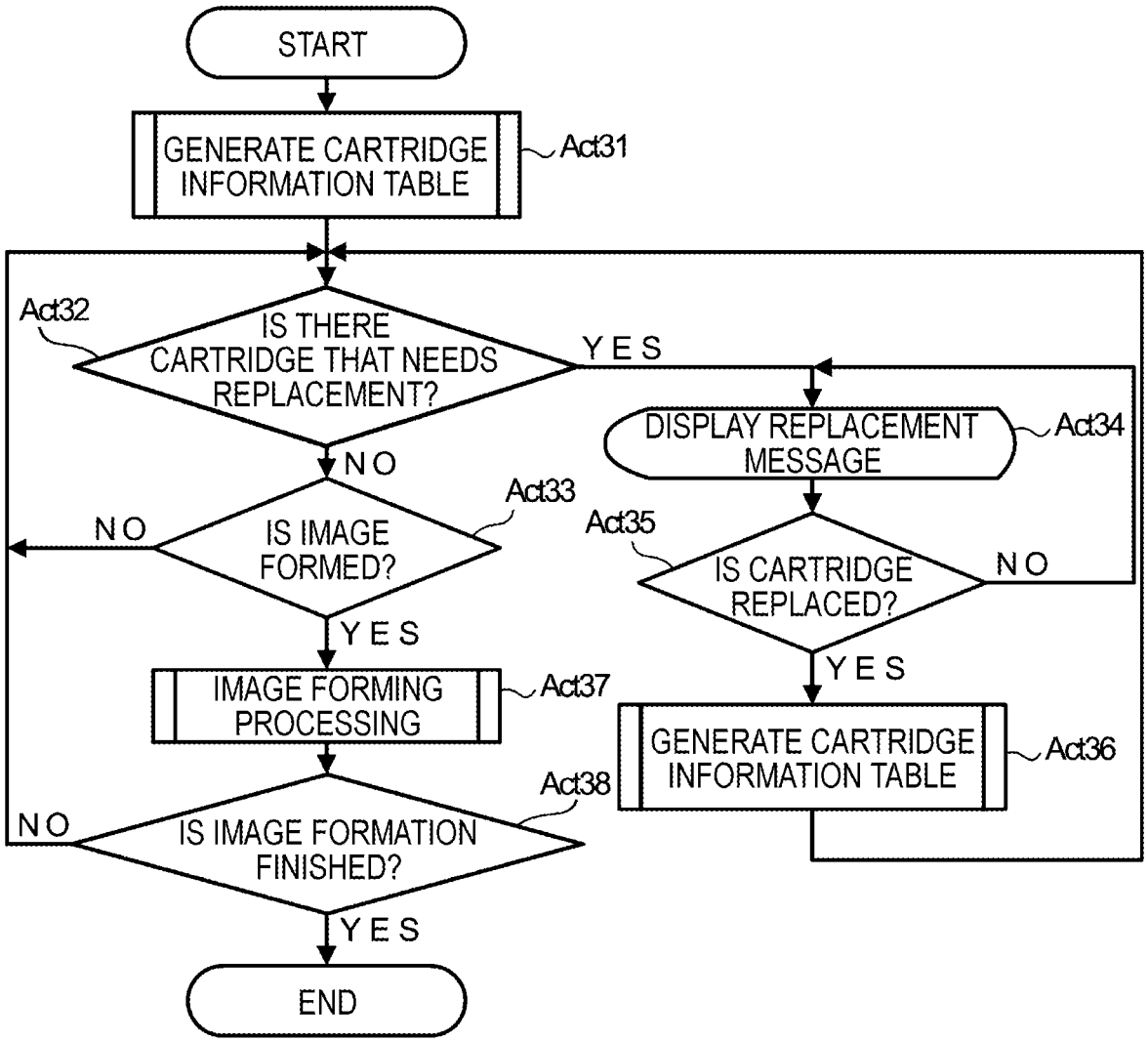
FIG. 12 is a flowchart illustrating an example of operation processing according to the modification example.

FIG. 12 is a flowchart illustrating an example of operation processing in the modification example of the image forming apparatus 1 according to the embodiment. The processor 21 performs the control processing illustrated in FIG. 12 according to the control program stored in the ROM 111.

Figure 13:
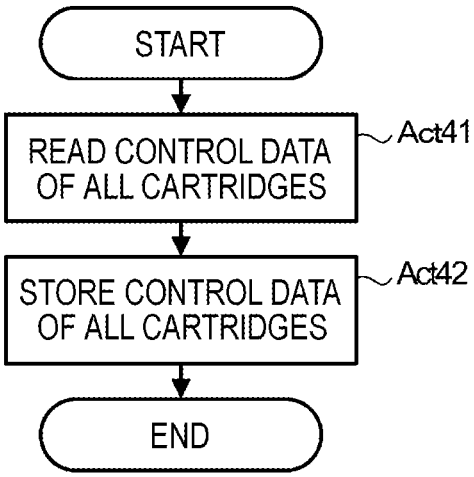
FIG. 13 is a flowchart illustrating an example of a cartridge information table generation subroutine in FIG. 12.

The processor 21 generates the cartridge information table by the cartridge information table generation subroutine (Act 31). FIG. 13 is a flowchart illustrating an example of the cartridge information table generation subroutine.

The processor 21 reads the control data from the cartridge memories 93 of all the toner cartridges 2 installed in the image forming apparatus 1 (Act 41). The processor 21 stores the control data of all the read toner cartridges 2 in the cartridge information table of the NVM 113 (Act 42). In addition, the processor 21 ends the processing of the cartridge information table generation subroutine.

The subsequent processing of Act 32 to Act 35 is the same as the processing of Act 21 to Act 24 described with reference to FIG. 9. Accordingly, the description thereof will be omitted. When it is determined in Act 35 that the corresponding toner cartridge 2 is replaced (YES in Act 35), the processor 21 recreates the cartridge information table according to the cartridge information table generation subroutine described with reference to FIG. 13 (Act 36). After this, the processor 21 determines the necessity of cartridge replacement in Act 32 again.

Figure 14:
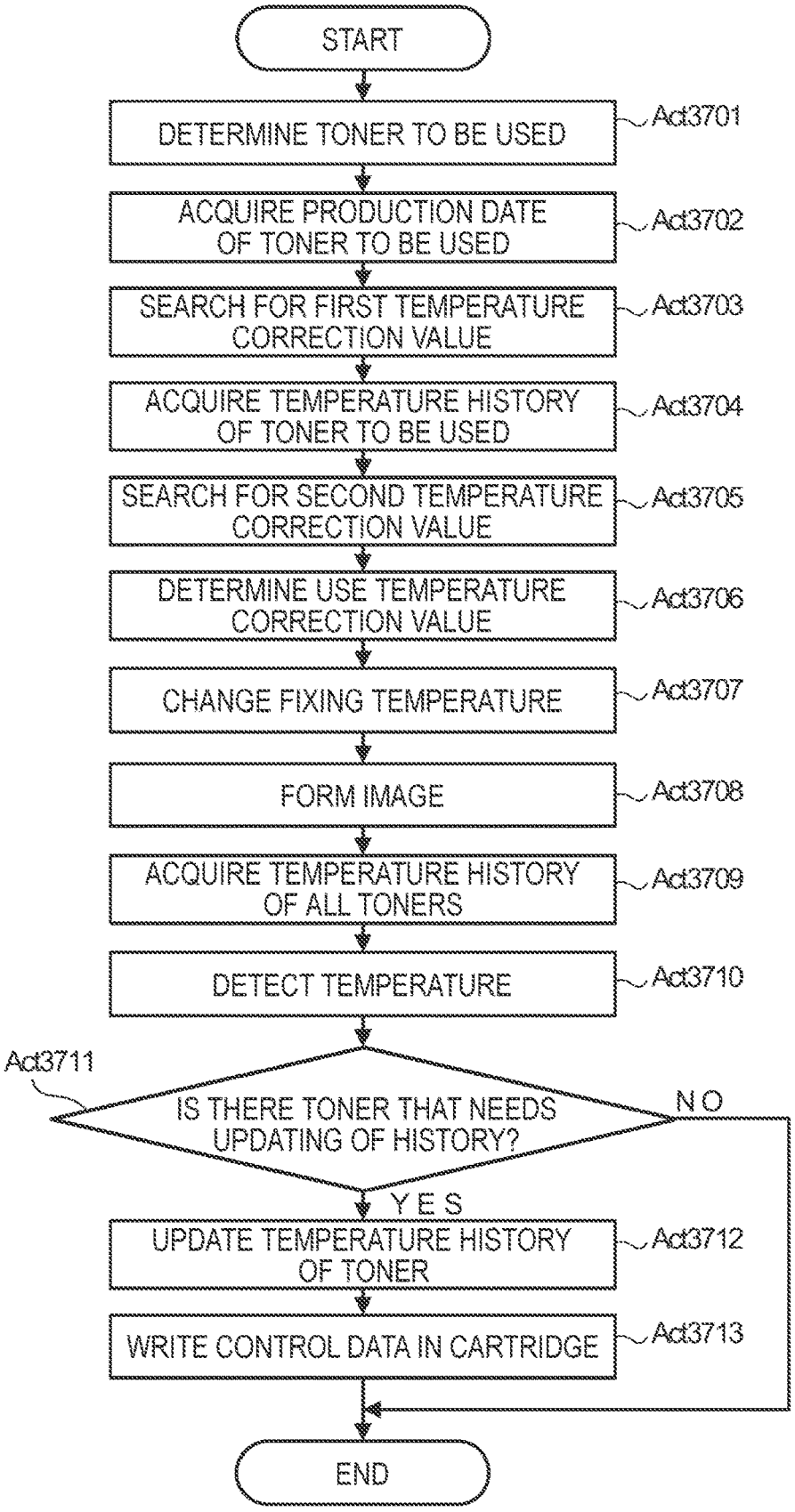
FIG. 14 is a flowchart illustrating an example of an image forming processing subroutine in FIG. 12.

In addition, when it is determined in Act 33 to perform the image formation (YES in Act 33), the processor 21 forms the image on the printing medium P by the image formation processing subroutine (Act 37). FIG. 14 is a flowchart illustrating an example of the image formation processing subroutine in FIG. 12. The subsequent processing of Act 3701 to Act 3712 is the same as the processing of Act 2801 to Act 2812 described with reference to FIG. 10. Accordingly, the description thereof will be omitted. After updating the temperature history information of the cartridge information table of the toner which needs to be updated in Act 3712, the processor 21 writes the control data in the cartridge memory 93 of the corresponding toner cartridge 2 (Act 3713). In addition, the processor 21 ends the image formation processing subroutine.

In this manner, the processing of Act 38 after the image is formed on the printing medium P by the processing of the image forming processing subroutine is the same as the processing of Act 19 described with reference to FIG. 7. Therefore, the description thereof will be omitted.

According to the above-described embodiment, each time an image is formed on the printing medium P, that is, each time the printing medium P is heated by the fixing device 20, the temperature and humidity sensor 43 detects the temperature of the inside of the image forming apparatus 1, the temperature history information which is a history of detected temperatures is stored in the cartridge information table of the memory 22 (NVM 113), and when the printing medium P is heated by the fixing device 20, the fixing temperature which is the temperature at heating in the fixing device 20 is determined based on the temperature history information stored in the cartridge information table. Accordingly, while realizing energy saving performance utilizing excellent low temperature fixing performance at the beginning of generation of toner that uses a crystalline polyester resin, even when using the toner in which annealing progressed under the long-term or high-temperature environment, by detecting this case and raising the fixing temperature, it is possible to prevent image defects due to cold offset.

In addition, a case where the temperature and humidity sensor 43 detects the entire ambient temperature in the image forming unit 19 after the image formation will be described. By detecting the ambient temperature close to each toner cartridge 2 using the drum temperature sensor 56, the temperature covered by the toner cartridge 2 may be detected more accurately.

While certain embodiments have been described, these embodiments have been presented by way of example only, and are not intended to limit the scope of inventions. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus comprising:

a temperature sensor configured to detect a temperature of an inside of the image forming apparatus;

a reader configured to read production date information from a recording medium of a first toner cartridge received by the image forming apparatus;

a memory configured to store temperature history information regarding a history of the temperature of the inside of the image forming apparatus detected by the temperature sensor;

a fixing device configured to fix a toner image onto a paper sheet by heating the paper sheet to a fixing temperature, wherein the toner image is transferred to the paper sheet using a first toner stored in the first toner cartridge; and a controller configured to:

determine a first temperature correction value based on the temperature history information stored in the memory;

determine a second temperature correction value based on a number of days elapsed from a production date of the first toner in the first toner cartridge, which is calculated based on the production date information read by the reader so that (i) the second temperature correction value is a first value when the number of days is a first number of days and (ii) the second temperature correction value is a second value greater than the first value when the number of days is a second number of days greater than the first number of days;

determine the fixing temperature based on a greater value of the first temperature correction value and the second temperature correction value; and control the fixing temperature at the fixing device.

2. The image forming apparatus of claim 1, wherein, after heating the paper sheet with the fixing device, the controller is configured to:

determine whether the temperature history information stored in the memory needs to be updated based on the temperature of the inside of the image forming apparatus detected by the temperature sensor in response to fixing the toner image to the paper sheet and the temperature history information stored in the memory; and update the temperature history information stored in the memory with the temperature of the inside of the image forming apparatus detected by the temperature sensor in response to fixing the toner image to the paper sheet when the temperature history information stored in the memory needs to be updated.

3. The image forming apparatus of claim 1, wherein the first toner cartridge is replaceable, and wherein the controller is configured to:

cause the reader to read the production date information from the recording medium of a second toner cartridge and cause the memory to store the production date information read by the reader in response to the first toner cartridge being replaced by the second toner cartridge; and calculate the number of days elapsed from the production date of a second toner in the second toner cartridge based on the production date information stored in the memory when the paper sheet is heated with the fixing device.

4. The image forming apparatus of claim 1, wherein:

the image forming apparatus is configured to receive the first toner cartridge and a second toner cartridge;

the fixing device is configured to heat the paper sheet to which the toner image with the first toner contained in the first toner cartridge and a second toner contained in the second toner cartridge is transferred to fix the toner image onto the paper sheet;

the memory is configured to store the temperature history information and the production date information corresponding to each of the first toner cartridge and the second toner cartridge; and the controller is configured to:

cause (i) the reader to read the production date information from the recording medium of the first toner cartridge or the second toner cartridge and (ii) the memory to store the production date information read by the reader when the first toner cartridge or the second toner cartridge is replaced, respectively; and calculate the number of days elapsed from the oldest production date based on the production date information of each of the first toner cartridge and the second toner cartridge stored in the memory when the paper sheet is heated with the fixing device; and determine the second temperature correction value in accordance with the number of days elapsed from the oldest production date.

5. The image forming apparatus of claim 4, wherein, after heating the paper sheet with the fixing device, the controller is configured to:

determine whether the temperature history information stored in the memory needs to be updated based on the temperature of the inside of the image forming apparatus detected by the temperature sensor in response to fixing the toner image to the paper sheet and the temperature history information stored in the memory and corresponding to the first toner cartridge and the second toner cartridge; and update the temperature history information stored in the memory with the temperature of the inside of the image forming apparatus detected by the temperature sensor in response to fixing the toner image to the paper sheet when the temperature history information stored in the memory needs to be updated.

6. The image forming apparatus of claim 5, wherein the controller is configured to:

write the temperature history information stored in the memory and corresponding to each of the first toner cartridge and the second toner cartridge into the recording medium of each of the first toner cartridge and the second toner cartridge after heating the paper sheet with the fixing device and updating the temperature history information as necessary; and cause the reader to read the production date information from the recording medium of each of the first toner cartridge and the second toner cartridge and cause the memory to store the production date information read by the reader when the image forming apparatus is initiated.

7. The image forming apparatus of claim 1, wherein the recording medium is an integrated circuit chip.

8. The image forming apparatus of claim 1, wherein the first toner includes a crystalline polyester resin.

9. An image forming apparatus comprising:

a controller including one or more memory devices coupled to one or more processors, the one or more memory devices configured to store instructions thereon that, when executed by the one or more processors, cause the one or more processors to:

acquire temperature information regarding a temperature of an inside of the image forming apparatus;

acquire production date information from a toner cartridge received by the image forming apparatus;

store temperature history information regarding a history of the temperature of the inside of the image forming apparatus;

determine a first temperature correction value based on the temperature history information;

determine a second temperature correction value based on a number of days elapsed from a production date of toner in the toner cartridge, which is calculated based on the production date information;

determine a fixing temperature at a fixing device based on a greater value of the first temperature correction value and the second temperature correction value; and control the fixing device to provide the fixing temperature to fix an image formed using the toner in the toner cartridge onto a sheet.

10. The image forming apparatus of claim 9, wherein (i) the second temperature correction value is a first value when the number of days is a first number of days and (ii) the second temperature correction value is a second value greater than the first value when the number of days is a second number of days greater than the first number of days.

11. The image forming apparatus of claim 9, wherein the one or more memory devices are configured to store instructions thereon that, when executed by the one or more processors, cause the one or more processors to:

determine whether the temperature history information needs to be updated based on the temperature of the inside of the image forming apparatus in response to fixing the image to the sheet and the temperature history information; and update the temperature history information with the temperature of the inside of the image forming apparatus in response to fixing the image to the sheet when the temperature history information needs to be updated.

12. The image forming apparatus of claim 9, wherein the toner includes a crystalline polyester resin.

13. The image forming apparatus of claim 9, further comprising the fixing device.

14. The image forming apparatus of claim 9, further comprising a reader configured to read the production date information from the toner cartridge.

15. The image forming apparatus of claim 9, further comprising a temperature sensor configured to detect the temperature of the inside of the image forming apparatus.

16. An image forming apparatus comprising:

a controller including one or more memory devices coupled to one or more processors, the one or more memory devices configured to store instructions thereon that, when executed by the one or more processors, cause the one or more processors to:

acquire production date information from a toner cartridge received by the image forming apparatus;

determine a production date temperature correction value based on a number of days elapsed from a production date of toner in the toner cartridge, which is calculated based on the production date information, wherein (i) the production date temperature correction value is a first value when the number of days is a first number of days and (ii) the production date temperature correction value is a second value greater than the first value when the number of days is a second number of days greater than the first number of days;

determine a fixing temperature at a fixing device based on the production date temperature correction value; and control the fixing device to provide the fixing temperature to fix an image formed using the toner stored in the toner cartridge onto a sheet.

17. The image forming apparatus of claim 16, wherein the one or more memory devices are configured to store instructions thereon that, when executed by the one or more processors, cause the one or more processors to:

acquire temperature information regarding a temperature of an inside of the image forming apparatus;

store temperature history information regarding a history of the temperature of the inside of the image forming apparatus;

determine a temperature history temperature correction value based on the temperature history information; and determine the fixing temperature at the fixing device based on a greater value of the production date temperature correction value and the temperature history temperature correction value.

18. The image forming apparatus of claim 17, further comprising a temperature sensor configured to detect the temperature of the inside of the image forming apparatus.

19. The image forming apparatus of claim 16, further comprising the fixing device.

20. The image forming apparatus of claim 16, further comprising a reader configured to read the production date information from the toner cartridge.

* * * * *